United States Patent [19]

Krutsch

[11] Patent Number: 4,848,748

[45] Date of Patent: Jul. 18, 1989

[54] BALL LIFTER MECHANISM

[75] Inventor: John R. Krutsch, Glenview, Ill.

[73] Assignee: Williams Electronic Games, Inc., Chicago, Ill.

[21] Appl. No.: 232,178

[22] Filed: Aug. 15, 1988

[51] Int. Cl.[4] ..... A63D 3/02; A63F 9/00

[52] U.S. Cl. ..... 273/121 E; 273/1 M; 446/136

[58] Field of Search ..... 273/121 E, 121 D, 121 A, 273/201, 1 M, 120 R; 446/136

[56] References Cited

U.S. PATENT DOCUMENTS

| | | | |
|---|---|---|---|
| 2,012,519 | 8/1935 | Radtke | 273/121 E |
| 2,584,956 | 2/1952 | Williams | 273/121 E |
| 2,618,480 | 11/1952 | Williams | 273/201 |
| 4,032,148 | 6/1977 | Sanders | 273/121 E |
| 4,355,811 | 10/1982 | Williams | 273/201 |
| 4,364,196 | 12/1982 | Shacket | 273/1 M |

*Primary Examiner*—Edward M. Coven
*Assistant Examiner*—Gary Jackson
*Attorney, Agent, or Firm*—Rockey and Rifkin

[57] ABSTRACT

In a coin operated amusement game such as a pinball machine with horizontal and vertical playfields, an apparatus for lifting a pinball from a horizontal playfield to a vertical playfield is disclosed. A reversing screw, a motor to rotate the screw in one direction, an electromagnet for lifting and holding the pinball as it is moved from the horizontal to the vertical playfield, and a carrier means that travels on the reversing screw cooperate with an electromagnet that lifts the pinball.

8 Claims, 2 Drawing Sheets

FIG. 1
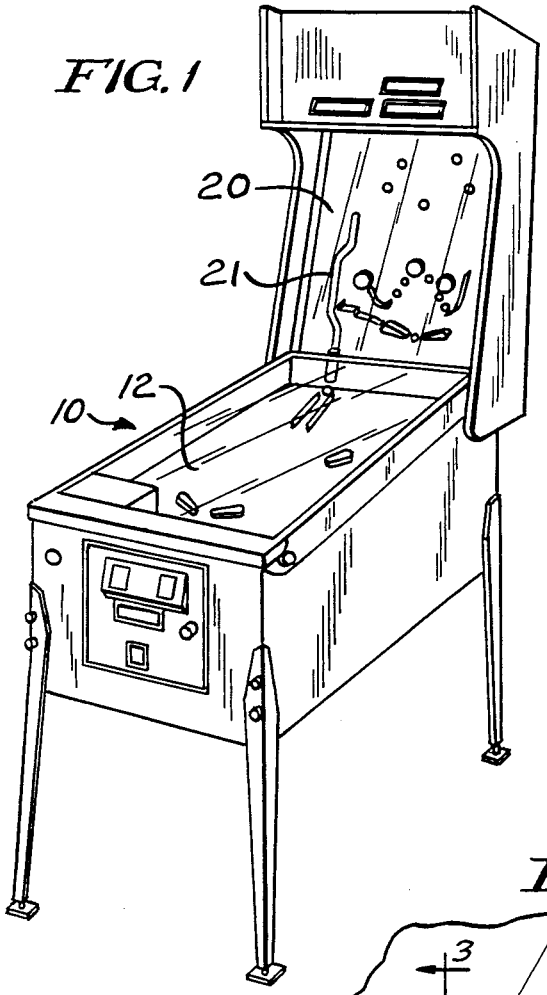
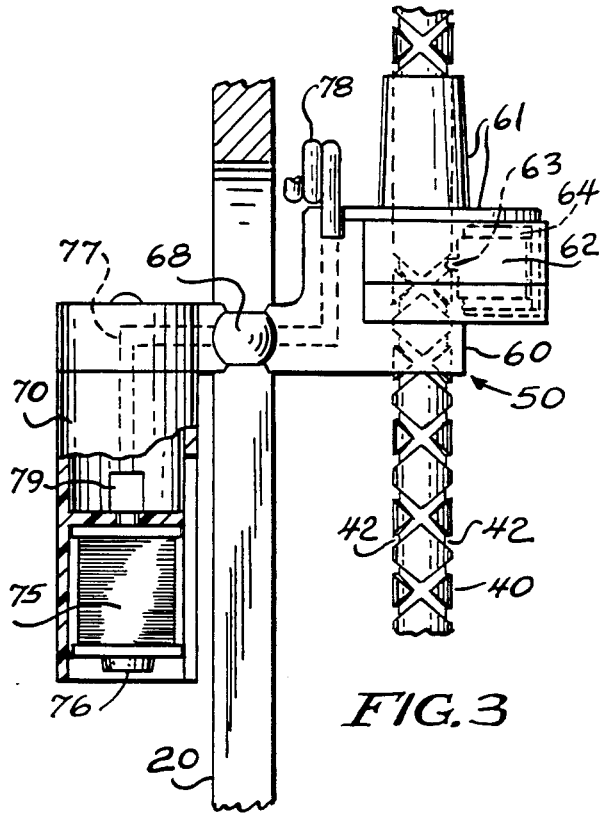
FIG. 3
FIG. 2
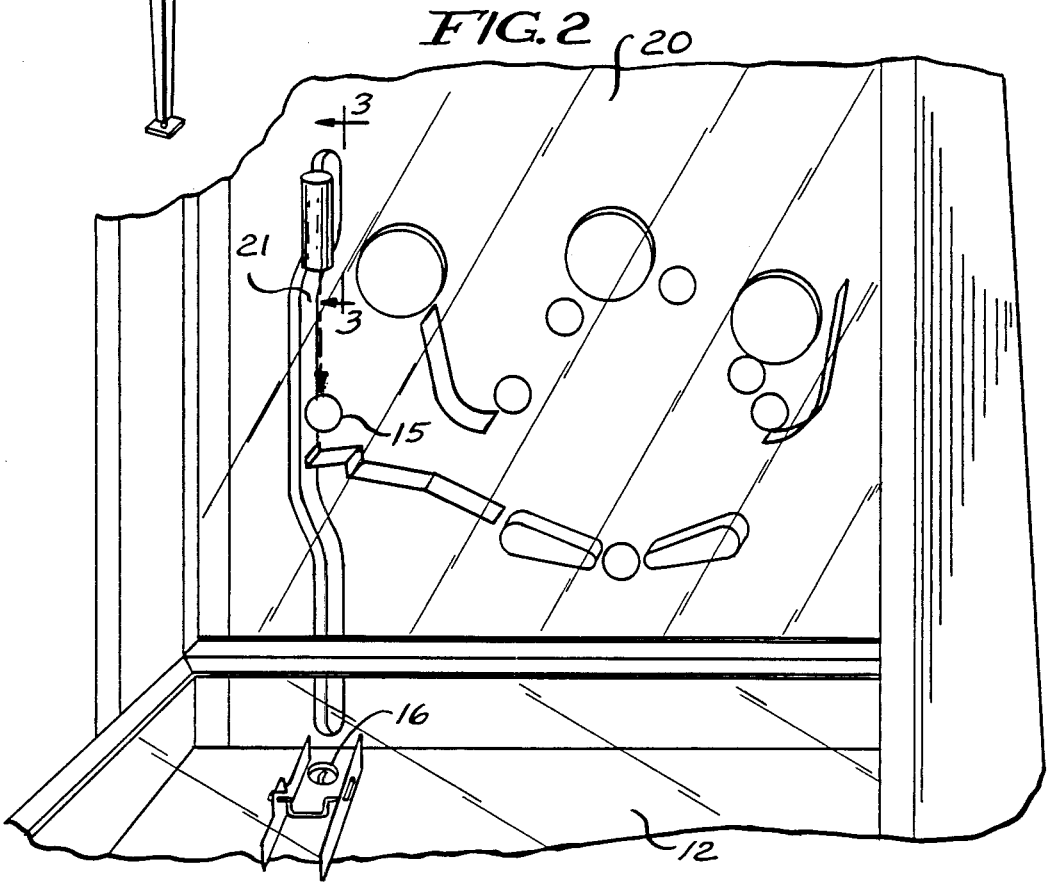

BALL LIFTER MECHANISM

BACKGROUND OF THE INVENTION

This invention relates to a device useful in coin operated amusement games such as pinball machines with vertical playfields. The device can move the pinball from a horizontal playfield to a vertical one.

A recent development in the art of coin operated amusement games is a pinball machine that has both horizontal and vertical playfields. Such a device is described in the pending application to Lawlor and Demar entitled "Pinball Machine," Ser. No. 07/063,126, filed June 17, 1987. That application also describes a winch and an electromagnet for lifting the ball to the vertical playfield. One of the problems with the winch device is that it requires a reversible motor and logic to control the reversing function. This can create problems, as can cable fouling on the winch. Consequently, it was desired to develop a more reliable apparatus to move the ball from a horizontal to a vertical playfield.

SUMMARY OF THE INVENTION

The present invention solves the problems of the prior ball lifting device by using a rotation means such as a motor that only rotates in one direction. The motor turns a reversing screw whose rotation moves a carrier means up and down the reversing screw. The carrier means has an electromagnet secured thereto to pick up the ball from the horizontal playfield and release it into the vertical playfield.

One feature of the invention is the use of a Teflon® coating for the reversing screw to reduce friction. The tapered tip of the screw also reduces friction and the consequent motor wear.

Another aspect of the invention is that the power to the electromagnet is provided by a coiled cable connected to the carrier. In addition, the carrier is adapted to move without binding through a serpentine slot in the vertical playfield. A significant aspect of the electromagnet is that it is powerful enough to lift the ball before the ball and the magnet actually make contact. This eliminates a possible motor stall that could occur if physical contact were required for the magnet to engage the ball.

The carrier means possesses additional features that improve the operation of the ball lifter. In particular, the carrier means is dimensioned to engage limit switches that signal the game controls to permit monitoring and, if necessary, override of the lift mechanism operation. Preferably, the carrier means is constructed with rounded projections that facilitate the movement of the carrier through a serpentine slot in the vertical playfield. These and other objects and advantages of the invention are disclosed in the drawings and remaining portion of this specification.

BRIEF DESCRIPTION OF THE DRAWINGS

FIG. 1 is a perspective view of a pinball machine with horizontal and vertical playfields;

FIG. 2 is a close-up, front perspective of the vertical playfield in which the electromagnet has dropped a ball into the playfield;

FIG. 3 is a vertical section, taken through 3—3 of FIG. 2, showing the electromagnet on one side of the vertical playfield and the carrier and reversing screw on the other side of the playfield;

DETAILED DESCRIPTION OF THE PREFERRED EMBODIMENTS

Figure 4:
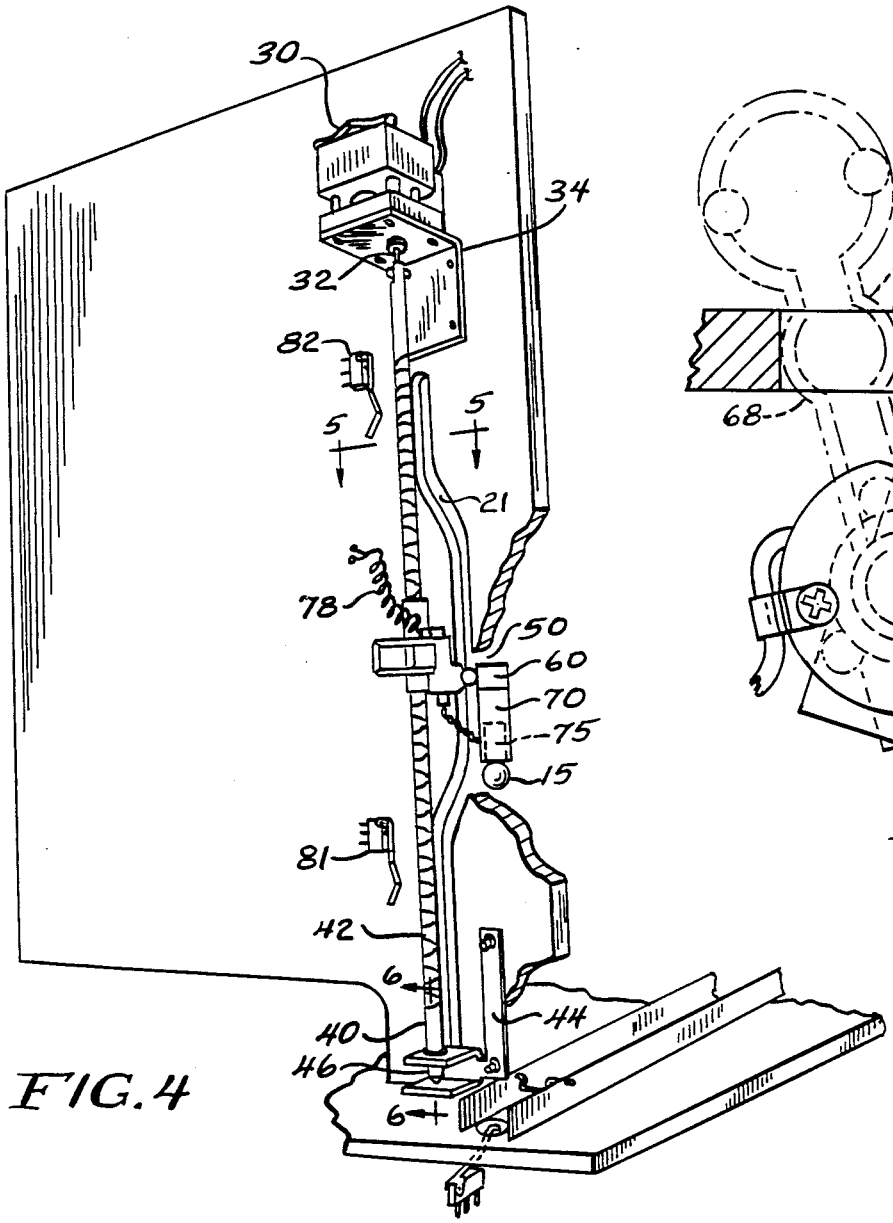
FIG. 4 is a perspective view from the rear of the vertical playfield, showing the complete ball lifter mechanism.
Figure 5:
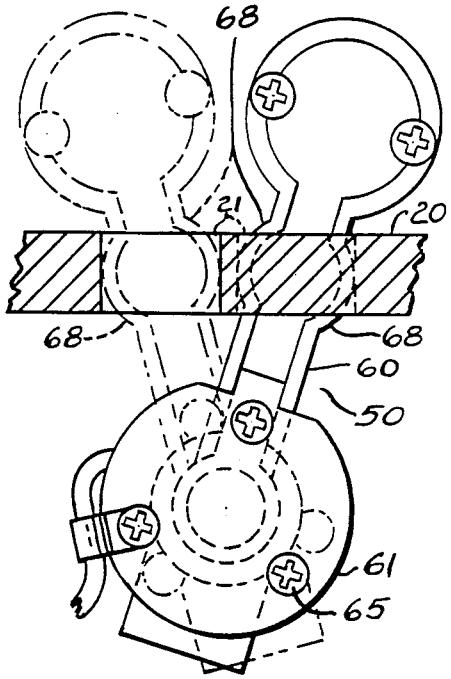
FIG. 5 is a plan section, taken through 5—5 of FIG. 4, depicting the carrier at different positions in a serpentine slot.

The structure of the present invention is best understood in the context of its use and method of operation. In FIG. 1, a pinball machine 10 has a generally horizontal playfield 12 and a generally vertical playfield 20. If a player meets certain game requirements while playing on the horizontal playfield 12, he is given the opportunity to continue play on the vertical playfield 20. In a particular embodiment, vertical play is initiated by positioning the ball 15 in capture recess 16 in the horizontal playfield. Access to the recess 16 is obtained by hitting certain targets or by executing a skill shot as designed by the game designer. When the ball 15 is detected in recess 16, the ball lifter mechanism of the present invention is enabled by the game control system.

The ball lifter includes a motor 30 (FIG. 4) which drives a reversing screw 40. Brackets 34 and 44 secure the lifter to the rear of the vertical playfield. A carrier, generally designated as 50, travels on the reversing screw until the force of electromagnet 75, secured to the carrier 50, picks up the ball 15, which is made of ferromagnetic material. The ball 15 moves upward with the carrier's direction of travel, which has been reversed by the reversing screw. The carrier 50 travels upwardly until it reaches a point on the vertical playfield 20 where the ball is dropped into play, as shown in FIG. 2. Typically there is a slot 21 in the vertical playfield 20 in which the carrier moves.

The carrier moves vertically in slot 21. Only the ball 15, the electromagnet 75, and a portion of the carrier 50 are exposed to the player, while the remaining elements of the device are located behind vertical playfield 20.

Figure 6:
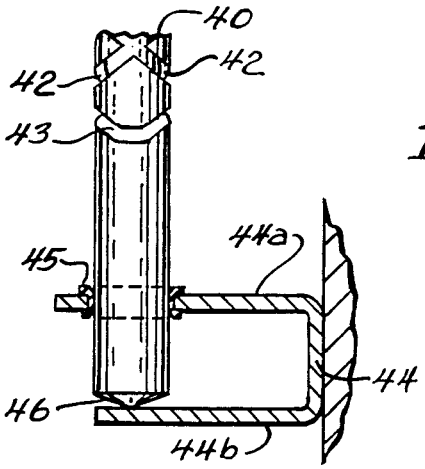
FIG. 6 is a vertical section, taken through 6—6 of FIG. 5, depicting the bottom of the reversing screw secured in a bracket.
Figure 7:
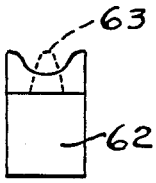
FIG. 7 is plan view of the screw follower and its arcuate tip, with a side view shown in phantom.

The screw 40 is operated by an AC motor, preferably 24 volts. The motor 30, rotates in one direction only at about 350 rpm. The screw 40 is preferably aluminum with a Teflon® impregnated hard coat finish to reduce friction between it and the carrier. The screw 40 has threads or grooves 42 that intersect in a double helix configuration. The top and bottom of the screw 40 end in transition sections 43 (FIG. 6) that cause the carrier 50 to reverse its direction of vertical movement even though the screw 40 always rotates in the same direction.

The lower end of the screw 40 is rotatably secured in a bracket 44 having an upper plate **44*a* and lower support plate 44*b*. The lower end of the screw 40 passes through a hole in upper plate 44*a* with nylon bearing 45. The bearing 45 limits the motion of the screw 40 to pure rotation while reducing friction. The tip 46 of the screw 40 rests on support plate 44*b* and is preferably tapered to a point, also to minimize friction. The output shaft 32 of motor 30 is coupled to the upper end of the screw 40**.

The motor 30 is secured to bracket 34 on the backside of the playfield 20.

The carrier 50 preferably consists of three sections: a carrier body 60, carrier top 61, and carrier tube 70. The body 60 cooperates with the reversing screw 40. A screw follower 62 fits in the rear portion of the body 60. The screw follower 62 has a tip 63 with an arcuate end that engages the helical grooves 42. The screw follower fits inside a bearing 64, so it can rotate and follow the grooves. Access to the screw follower 62 is obtained by removing screws 65 which secure the carrier top to the carrier body.

On the player side of the playfield 20, carrier tube 70 is secured to the underside of carrier body 60. The tube 70 is dimensioned to receive the electromagnet 75. When current is supplied to electromagnet 75 via wires 77, the core 76 is magnetized with enough force to lift ball 15 before there is actually contact between core 76 and ball 15. The wires 77 are connected to a coiled cord 78, which is preferably secured to a power supply near the top of vertical playfield 20 in the vicinity of motor 30. The cord 78 stretches and recoils in the same way as a telephone cord. FIG. 4 depicts the cord 78 disconnected from the power supply so other details of the invention are not obscured.

If desired, the position of the carrier 50 can be monitored through the use of microswitches located in the path of the carrier top 61. Switch 82 (FIG. 4) may be used to signal when to cut off the power to electromagnet 75, so that ball 15 drops into the vertical playfield 20. Switch 81 can be used to signal when to cut power to the motor 30, to stop the rotation of screw 40 when the vertical playfield is not in use. Thus motor 30 and electromagnet 75 remain unpowered until the lifter is again actuated by the game's controller.

Preferably the carrier body 60 is hollow and contains wires 77 that are not exposed and cannot contact the edges of slot 21. Wires 77 terminate in plastic clip 79, so that the wires 77 can be easily connected to electromagnet 75.

Rounded, sphere-like projections 68 are located on carrier body 60. These projections 68 are positioned within slot 21. The projections 68 keep the carrier body 60 from binding in slot 21 if the slot is curved or serpentine, as may be desirable.

Various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

What is claimed is:

1. A ball lifter mechanism for use with an amusement game having ferromagnetic balls comprising:

a reversing screw rotatably secured to said game;

motor means coupled to said reversing screw for rotating said screw; and carrier means having a magnetic element and secured to said screw for vertical movement on said screw between raised and lowered positions, whereby a ball positioned beneath said carrier means will be attracted to said magnetic element and lifted therewith during movement of the carrier means between the lowered and raised positions.

2. The apparatus of claim 1 wherein said magnetic element is an electromagnet and further includes switch means for enabling and disabling said electromagnet whereby a ball can be lifted and then released.

3. The apparatus of claim 2 wherein said amusement game is a pinball game having a vertical playfield, the electromagnet being operated to lift the ball and release it into the vertical playfield.

4. The apparatus of claim 3 wherein said carrier means travels between said raised and lowered positions with a portion of said carrier means disposed in a slot in said vertical playfield, said carrier means including projection means for causing said carrier means to follow the contour of said slot without binding.

5. The apparatus of claim 1 wherein said amusement game is a pinball game having vertical and horizontal playfields, the electromagnet being operated to lift the ball from the horizontal playfield to the vertical playfield.

6. The apparatus of claim 1 wherein said motor means rotates said reversing screw in one direction only, said reversing screw including:

grooves arranged in a double helix configuration in which the carrier means travels, and transition means at both ends of said reversing screw for reversing the direction of travel of said carrier means in said grooves; and whereby the carrier means is caused to reciprocate between said raised and lowered positions.

7. The apparatus of claim 1 wherein said motor means is a DC unidirectional motor.

8. The apparatus of claim 1 further including means for detecting the position of said carrier means to identify when it has reached its raised and lowered positions.

* * * * *